US006994619B2

(12) United States Patent
Scholten

(10) Patent No.: US 6,994,619 B2
(45) Date of Patent: Feb. 7, 2006

(54) OPTICAL SASH SENSING SYSTEM FOR FUME HOODS

(75) Inventor: Jean H Scholten, Roswell, GA (US)

(73) Assignee: Triatek, Inc., Norcross, GA (US)

( * ) Notice: Subject to any disclaimer, the term of this patent is extended or adjusted under 35 U.S.C. 154(b) by 461 days.

(21) Appl. No.: 10/378,033

(22) Filed: Mar. 4, 2003

(65) Prior Publication Data

US 2005/0048900 A1 Mar. 3, 2005

(51) Int. Cl.
*B08B 15/02* (2006.01)

(52) U.S. Cl. ..... 454/61

(58) Field of Classification Search ..... 454/61, 454/59

See application file for complete search history.

(56) References Cited

U.S. PATENT DOCUMENTS 4,528,898 A * 7/1985 Sharp et al. ..... 454/61
4,706,553 A * 11/1987 Sharp et al. ..... 454/61
4,893,551 A * 1/1990 Sharp et al. ..... 454/56
5,117,746 A * 6/1992 Sharp ..... 454/61
5,313,069 A * 5/1994 Tham ..... 250/559.26
6,137,403 A * 10/2000 Desrochers et al. ..... 340/540
6,358,137 B1 * 3/2002 Threlfall ..... 454/61
6,556,153 B1 * 4/2003 Cardamone ..... 341/111
2004/0072529 A1 * 4/2004 Desai ..... 454/61

* cited by examiner

*Primary Examiner*—Harold Joyce
(74) *Attorney, Agent, or Firm*—James Kuan

(57) ABSTRACT

A fume hood optical sash sensing system for controlling the flow of air into a fume hood to maintain a constant face velocity by utilizing an optical sensing device mounted inside the fume hood that can sense the movement of a sash based on repeatable reflexive tape to produce an output control signal that corresponds to sash movement to produce desired airflow into the fume hood. The system includes an optical sensing device with a light source, reflexive tape with a repetitive, quadrature encoded pattern, a smart controller device that receives output control signals from the optical sensing device, and an actuation device capable of receiving the output signal from the controlling device to control the damper device that will result in constant face velocity across the face of the sash.

20 Claims, 4 Drawing Sheets

Figure 2A
Figure 2B
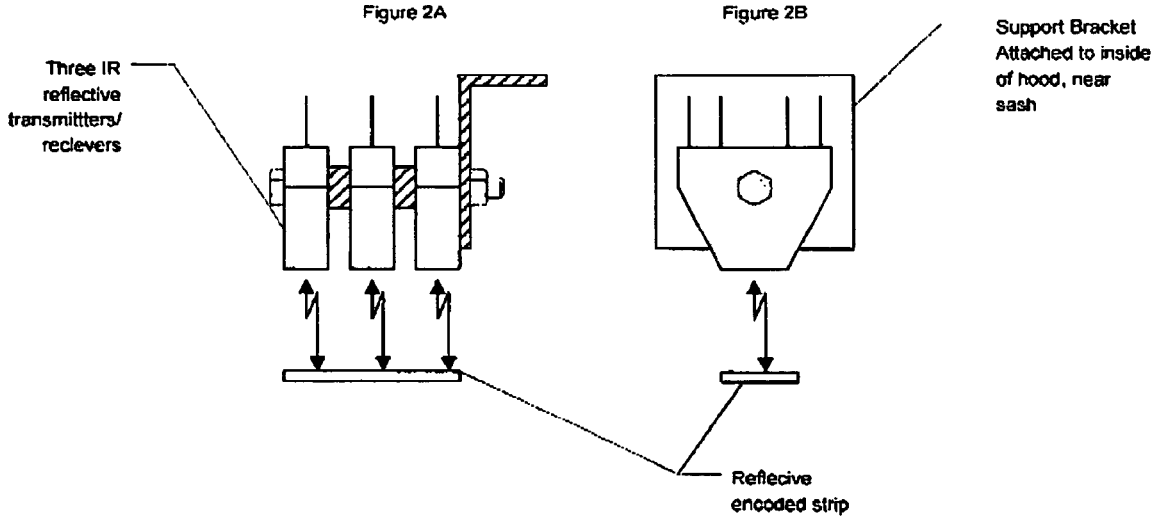
Figure 2C
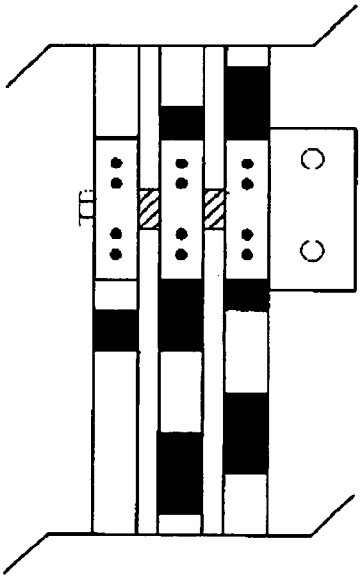

OPTICAL SASH SENSING SYSTEM FOR FUME HOODS

FIELD OF THE INVENTION

This invention relates to laboratory fume hoods and more specifically to apparatus for detecting the extent to which the sashes of a fume hood are open.

BACKGROUND OF THE INVENTION

The use and development of laboratory fume hoods for cutting edge research dealing with everything from bioterrorism to the human genome has resulted in many inventions to handle harmful materials safely and engendered much debate about the best way to control airflow through the fume hood. This debate concerns the capture of contaminants and the prevention of their escape into the surrounding environs where the lives of laboratory researchers, students, teachers, occupants, technicians and other personnel may be threatened. Various types of fume hoods with various types of configurations all utilize various sash mechanisms which promise safety to the user by their closing the sash during their experiments so that an exhaust fan can draw toxic fumes, pathogens and contaminants inside the hood away from the operator, and exhaust them through a laboratory exhaust ventilation fan. Dangers of contamination exist, however, with respect to periods of time when the sashes of a respective fume hood are left open and there is much debate over the minimum face velocities that must be maintained for the fume hood user to be kept "safe". Further, there is also much debate with respect to what types of sensing mechanisms should be used to keep a user safe such as airflow measurement or sash sensing or a combination of both.

Various sash sensing devices have evolved to provide the quick speed of response necessary to maintain safety while also providing easy maintenance based on adjusting the blower and thus the exhaust volume of the hood linearly in proportion to the change in opening size of the hood to maintain a constant face velocity. This principle is for conventional fume hoods that form an enclosure that uses a horizontal or vertical sash which slides horizontally and/or vertically to provide a variable opening. The amount of air exhausted by the hood blower is constant, and the face velocity increases as the area of the sash opening decreases. See, U.S. Pat. Nos. 4,528,898 and 4,706,553. These systems calculate an assumed face velocity based on the position of the sash when the system is set up. Exhaust measured in cubic feet per minute (CFM) in the duct is measured and corresponding sash positions are assumed to result in particular face velocities based on the opening in the fume hood. These systems provide the advantage of quick response to changed airflows around the fume hood. That is, as sashes are raised and lowered, a mechanical linkage to the venturi valve, blade damper or other device is also moved proportionally to ensure that the corresponding CFM necessary to maintain an assumed face velocity based on the position of the sash at the hood will result. As sashes are moved up and down, the system thus, responds to adjust airflow accordingly.

U.S. Pat. Nos. 4,893,551 and 5,117,746b discuss additional styles of fume hoods wherein two or more sashes are mounted to slide horizontally on at least two tracks which are located on the top and bottom of the sash opening. They also apply to fume hoods which have sashes mounted on tracks for horizontal movement, which tracks are, in turn, mounted on a sash frame which may be moved vertically; i.e., a combination sash having a combination sash frame. These patents also discuss techniques which may be utilized with such sashes to determine the sash opening. As is noted in these patents, with two or more sashes, absolute position of the sashes is not sufficient information by itself to indicate the open area of the hood. Instead, it is the relative position of the two or more sashes of the hood which determine the total open sash area. The problem becomes even more complex where four sashes are mounted on two tracks, which is a very common configuration, or where the hood is being moved both horizontally and vertically.

In the U.S. Pat. No. 4,893,551, the sash opening detection function is performed, in general, by having a source of radiation, and a detector for such radiation, and by mounting the source and detector relative to each other and to the sashes such that the amount of radiation detected is proportional to the uncovered portion of the opening. For preferred embodiments of the patent, various discrete magnetic or optical emitters and sensors mounted adjacent to or on the sashes are utilized to determine the fume hood opening. So, in this embodiment, sash position sensing uses assemblies of sensor elements mounted to the moveable sashes whose position is desired to be detected. Each assembly of sensor elements is electrically connected to external electronics through a sensor cable. Although this prior art is preferred over other available technology, such electrical connection methods for sash position sensing are less than optimal, particularly for cases where sensing is to be provided for horizontal sash, combination sash, or walk-in hood types. Routing the horizontal sash sensor cable presents difficulties related to either the establishment of operative pivot points or mounting a take-up reel for cable movement. The issues faced include both real and perceived reduced reliability over time due to cable wear, difficulties in installation, and the poor aesthetics of exposed cable that moves in a pendulous manner.

Other issues with conventional technology have been with the thickness of the sensor and magnet bars, given the increasing trends for tighter hood construction and, thus, reduced spacing between sashes from one track to another. Alternatively, a ¾" limitation on maximum distance between the surface of the sensor bar magnet and that of the reed switch sensor assembly is occasionally an issue with larger, more loosely designed hoods, so improvements in sensor sensitivity is desirable. See U.S. Pat. No. 4,893,551.

Recent developments such as U.S. Pat. No. 6,137,403 show a fume hood sash sensor using multiplexed sensors to measure sash position. The sensor transmitter or receiver elements may be multiplexed. Furthermore, the sensor may employ passive, passive remote powered transponder, or powered transponder elements on the sashes to measure sash position. The multiplicity of elements can be cost prohibitive and difficult to maintain. Also, see U.S. Pat. No. 6,358,137 which uses a rotary position sensor with a lever arm mechanism which translates horizontal or vertical movement to rotary movement for determining the position of the sash door. The apparatus compensates for nonlinearity that results from the translation. However, this invention has proved to be impractical in the field, expensive, and not widely used due to the need for using an awkward lever in tandem with the rotary sensor.

Consequently, what is truly desired is a system that minimizes equipment so that cables, pulleys and wheels are eliminated while providing an easy to install yet effective way to measure the sash as it changes.

SUMMARY OF THE INVENTION

The system described herein overcomes the foregoing deficiencies and problems by providing an optical sash sensing system that utilizes reflective tape attached to the sash(es) on a hood with certain repeated patterns on it in conjunction with an optical sensing device mounted on the side of the hood that counts the number of repetitive patterns that pass by its sensing mechanisms to determine sash movement. The sensing device transmits this data to an associated controller which can then signal the appropriate actuator device to adjust airflow accordingly to maintain safe face velocity into the fume hood.

DRAWING DESCRIPTION

These and other aspects of the invention, its structure and use will be made even more clear to the person of ordinary skill in the art upon review of the following detailed description and the appended drawings in which key components of the invention are identified and briefly described below.

BRIEF DESCRIPTION OF THE DRAWINGS

FIG. 2A is an illustration of the 3 LED power sources that shine onto the three sections of the reflective tape mounted to the sash.

FIG. 2B is the diagram of the optical sensing device block mounted onto the side of the hood.

FIG. 2C is optical sensing device looking down onto the reflective tape as it is attached to the side of the sash.

DETAILED DESCRIPTION OF A PREFERRED EMBODIMENT

Figure 1:
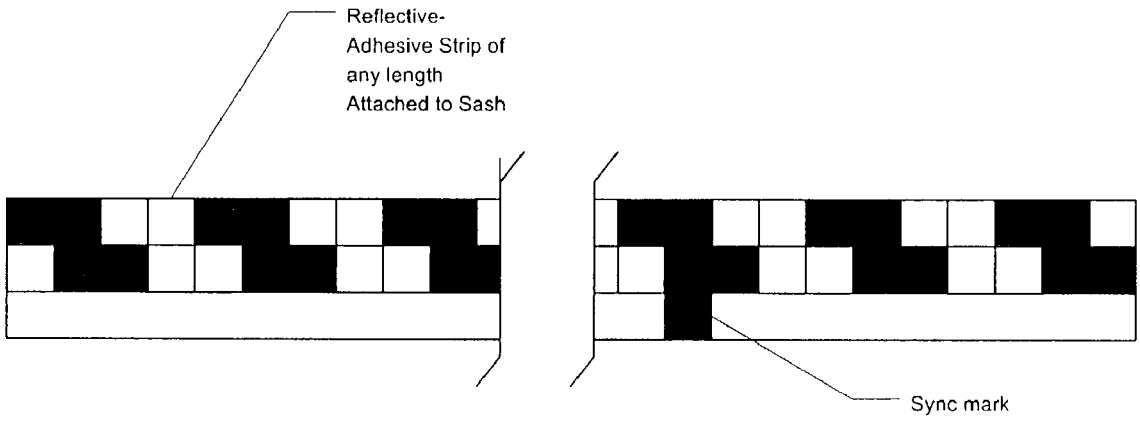
FIG. 1 is a diagram of the reflective tape in a quadrature pattern of black and white blocks that repeats itself over the length of the tape with a parallel side strip of white that has a lone black block on it as a reference point for the sensing device that is attached to the sash(es) in the hood.

With reference to FIG. 1 there is shown a condensed reproduction of the typical reflective adhesive tape that is used in this application. The tape is thin in width but has 3 distinct parallel sections or strips to it. On the bottom third of the tape that is depicted horizontally is a white reference strip that runs the length of the sash and is all white except for one black sync mark identified in the drawing which is used as a baseline reference point by the sensing device to count up or down in determining when the sash has moved. The top two-thirds of the tape are the repeated quadrature encoded patterns composed of four offset blocks of black and white that are repeated over the length of the tape. The white (or silver) blocks are reflected back onto the optical sensing device (FIG. 2) which is able to count these quad-blocks with reference to the sync point to determine the absolute value of the sash that has passed it as it is moved up or down to determine airflow adjustment. The black blocks do not reflect the light and serve as background to delineate the white block patterns. They form a continuous pattern of any length to conform to the needs of the sash. The squiggly lines in the middle of the illustrated tape represent an interruption to show that the tape can be of any length. If the device should lose track of the number of blocks that pass, the sync mark provides a fail-safe point to enable it to determine how far the sash has been moved. The sync mark is usually mounted strategically around the middle of the sash height so that as it is moved up or down, it is able to efficiently count the number of quad-blocks that pass. The tape can be as long or as short as is needed and is easily attached to the sash as needed. For horizontally sliding windows it can be mounted at the bottom of the frame and for vertical windows, it can be mounted at the top of the left or right side of the sash frame.

With reference to FIGS. 2A–2C there is shown front, side and top views of the block mounted optical sensing device that is used to count the quad-blocks on the reflective tape as the sash is moved up and down. As shown in FIG. 2A, the single device has 3 blocks to count the 3 sections of tape by using individual light sources in each block (such as infrared LED's that transmit directly onto the 3 sections of the reflective tape). The device is typically mounted onto the side or top of the hood inconspicuously out of view and about 0.5 cm from the sash itself. The tape then runs under the sensors as the sash is moved and based on the reflection from the tape as the LED lights are shined onto the tape, counts the number of quad-blocks that pass it based on the sash movement from which airflow can be adjusted accordingly.

In FIG. 2B, there is shown a side-view of the same optical sensing device. This view provides an angle that shows how the device is structured. An identified support bracket is used to attach the device to the inside of the hood near the sash. The tape is pointed out below the device and depicts how the light from the LED is reflected back up to the sensing device. In its typical form, its power source is based on the controller and utilizes 5 wires: 3 to feed each LED light source along with two more for a ground which serve as the return and a common for the detector. This will be more clear with reference to FIG. 4. The controller receives the quadrature signals from the device to calculate the absolute value of the sash and can directly move the actuator or in the case of other applications, use the signal for volumetric offset calculations.

FIG. 2C provides a top-down view that shows the optical device counting the quadrature encoded reflective tape as the sash is moved up or down. The 3 blocks of the device shine the LED lights onto the tape which reflect the white sections back up to the sensor which is then able to sum the number of blocks that pass the sensor as the sash is moved up or down. The tape can be as long or as short as is needed and is easily attached to the sash as needed.

Figure 3:
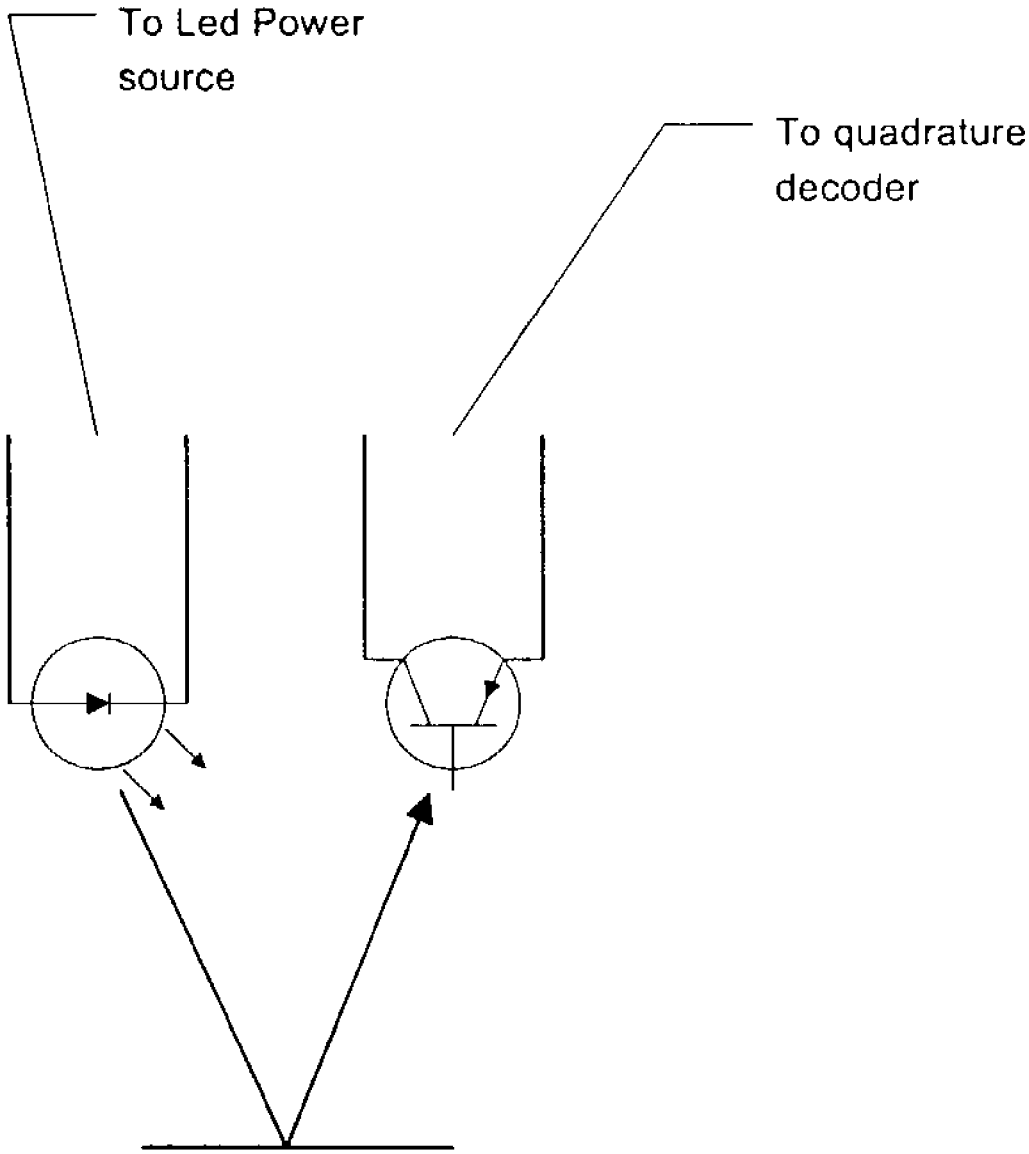
FIG. 3 is an illustration of how the sensing device is able to read the reflections of the LED shining off of the reflective tape to count the number of patterns that pass it in one typical sash movement.

FIG. 3 depicts the functionality of the optical sensing device. The sensor or quadrature decoder views the reflection of the light from the LED power source identified to the left as it bounces off the white portions of the reflective tape (as indicated by the horizontal line at the bottom of the figure) back up to the sensor. It detects the reflection of the LED power source off of the tape and is always on to detect sash movement at any time.

Figure 4:
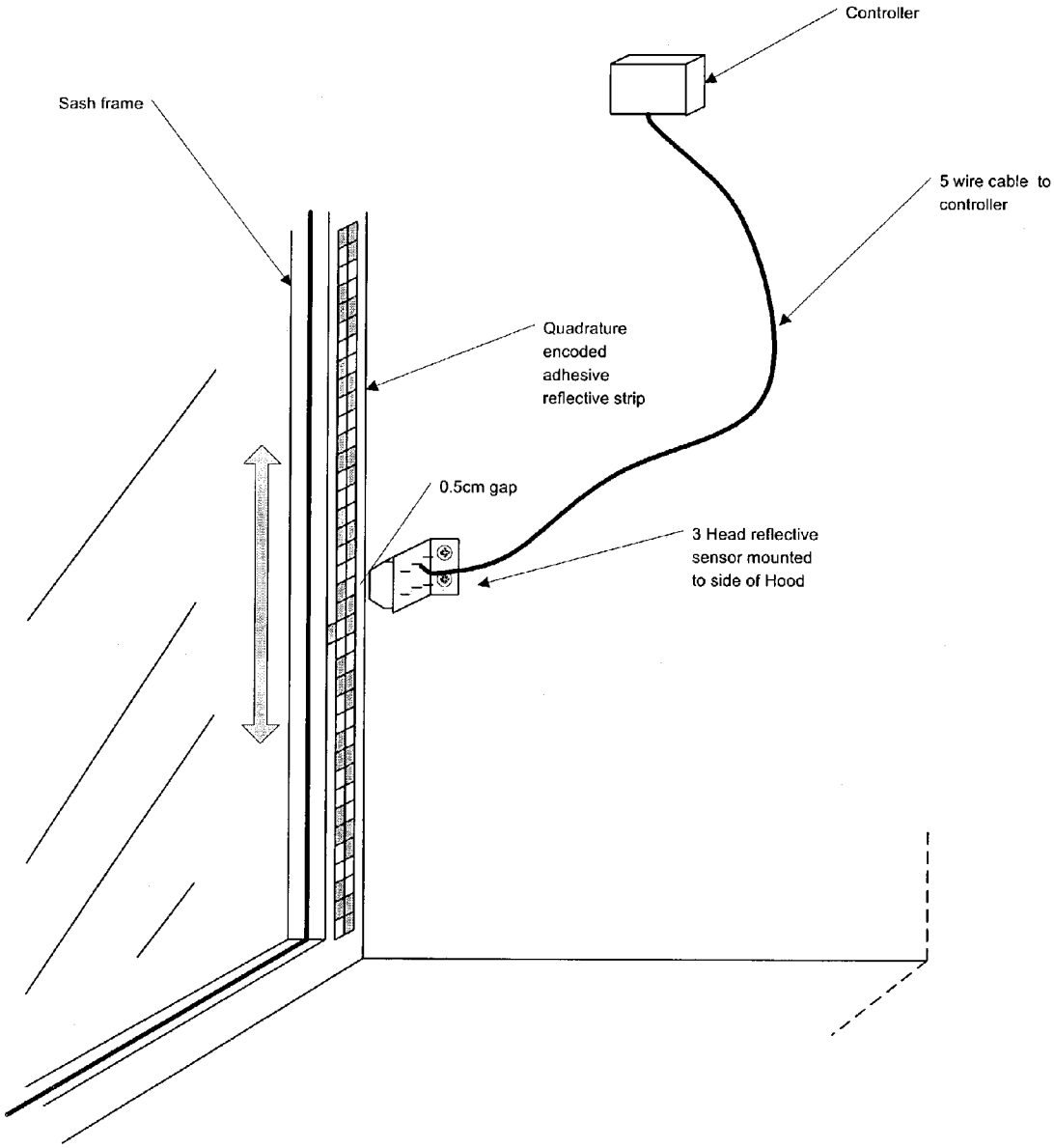
FIG. 4 is a "big picture" view of the invention that details the entire system as it is installed in a typical fume hood with a vertical sash that includes the tape, the sensor, the controller and a 5 wire cable to the controller.

Finally, with reference to FIG. 4, the overall picture of the invention in place from the view of a fume hood with a vertical sash is seen. The tri-headed reflective sensor mounted to the side of the fume hood is seen and positioned so that its tri-block LED light configuration is positioned to shine on and then detect the reflections from the quadrature encoded adhesive reflexive strip as the sash is moved up and down. The sensor is located at a 0.5 cm gap from the tape and remains unseen to the fume hood user based on its inconspicuous location. It is connected to the controller by 5 wire cable which is able to use the data from the sensor to count the number of blocks that pass the sensor as the sash is moved up or down to determine its absolute position with respect to the sync mark (FIG. 1) on the reflexive tape. The controller can be mounted at the top of the fume hood or any reasonable location in close proximity to the fume hood. The controller, based on the sash movement, is then able to output control a connected damper actuator or use the data imported from its sensor as part of a larger calculation for volumetric offset control.

While the foregoing constitutes a preferred embodiment of the invention, according to the best mode presently contemplated by the inventors of making and carrying out the invention, the invention is not limited to the embodiment described. In light of the present disclosure, various alternative embodiments will be apparent to those skilled in the art. Accordingly, changes can be made without departing from the scope of the invention as pointed out and distinctly claimed in the appended claims as interpreted literally or expanded to include all legal equivalents.

What is claimed is:

1. A system for quickly controlling directional airflow into a fume hood having a vertical sash that is composed of:

a. An optical sensing device mounted inside the fume hood with a light source that shines onto a reflective source and a sensing device that can sense the reflected light and determine the number of iterations of a repeated pattern on the reflective source and produce an output control signal that corresponds to sash movement to produce desired airflow into the fume hood b. A smart controller device that receives output control signals from the optical sensing device, said controller device having its own intelligence capable of producing a drive signal c. An actuation device capable of receiving the output signal from the controlling device to adjust an airflow control device such as a venturi valve or blade damper or some other device that modulates airflow into a duct or other airflow stream, d. Reflective tape mounted strategically on a fume hood sash(es) with proportional, repetitive, encoded patterns on it that can be read by the optical sensing device as the sash is opened or closed on the fume hood.

2. The controlling system in claim 1, such that the optical sensing device detects the reflected patterns on the tape as the sash of the fume hood is moved up or down.

3. The controlling system in claim 2, such that when the optical sensing device detects the number of reflected patterns changing with respect to a baseline mark on the tape by counting the number of quadrature patterns on the tape such that the sash is being raised, it calculates the amount of movement in the sash and signals the associated actuator to move in a pre-programmed amount with respect to the distance of the sash movement to increase the level of airflow being exhausted from the hood.

4. The controlling system in claim 3, such that the smart controller device will signal the airflow control device to open to its proportional flow position with respect to the incremental sash position change virtually instantaneously.

5. The controlling system in claim 4 such that the airflow control device will achieve its maximum flow position in less than a second after detection of the sash movement.

6. The controlling system as recited in claim 5, such that the optical sensing device determines that the number of reflected patterns is moving in such a way by counting the number of quadrature patterns as to indicate that the sash is being closed from an open position with respect to a baseline mark on the tape, it calculates the amount of movement in the sash and signals the associated actuator to move in a pre-programmed amount with respect to the distance of the sash move closing to decrease the level of airflow being exhausted from the fume hood.

7. The controlling system in claim 6, such that the smart controller device will signal the airflow control device to close to its proportional flow position with respect to the incremental sash position change virtually instantaneously.

8. The controlling system in claim 7 such that the airflow control device will achieve its decreased flow position in less than a second after detection of the sash movement.

9. The controlling system as recited in claim 8 but further comprising a fume hood with a horizontal sash, such that the optical sensing device determines that the number of reflected patterns is moving in such a way by counting the quadrature encoded patterns as they pass by the sensor as to indicate that the sash(es) are being opened from a closed position with respect to a baseline mark on the tape, it calculates the amount of movement in the sash(es) and signals the associated actuator to move in a pre-programmed amount with respect to the distance of the sash move opening to decrease the level of airflow being exhausted from the fume hood.

10. The controlling system in claim 9, such that the smart controller device will signal the airflow control device to open to its proportional flow position with respect to the incremental horizontal sash position change virtually instantaneously.

11. The controlling system in claim 10 such that the airflow control device will achieve its increased flow position in less than a second after detection of the sash movement.

12. The controlling system as recited in claim 11 such that the optical sensing device determines by counting the number of reflected patterns being detected that one or more sashes are being closed from an open position with respect to a baseline mark on the tape(s), it calculates the amount of movement in the sashes and signals the associated actuator to move in a pre-programmed amount with respect to the distance of the sash move closing to decrease the level of airflow being exhausted from the fume hood.

13. The controlling system in claim 12, such that the smart controller device will signal the airflow control device to close its proportional flow position with respect to the incremental sash position change virtually instantaneously.

14. The controlling system in claim 13 such that the airflow control device will achieve its decreased flow position in less than a second after detection of the sash movements.

15. The controlling system as recited in claim 14 but further comprising a fume hood with a combination sash and multiple optical sensing devices tied to a single controller along with multiple reflective tapes along with the plural sashes in a combinational sash fume hood, such that the optical sensing devices determine the number of reflected patterns moving in such a way by counting the quadrature encoded patterns as they pass by the sensor(s) as to indicate that the sash is being opened from a closed position with respect to a baseline mark on the tape, it calculates the amount of movement in the sash(es) and signals the associated actuator to move in a pre-programmed amount with respect to the distance of the sash movement opening to increase the level of airflow being exhausted from the fume hood.

16. The controlling system in claim 15, such that the smart controller device will signal the airflow control device to open to its proportional flow position with respect to the incremental combinational sash position change virtually instantaneously.

17. The controlling system in claim 16 such that the airflow control device will achieve its increased flow position in less than a second after detection of the sash movement.

18. The controlling system as recited in claim 17 such that the optical sensing device determines by counting the number of reflected patterns being detected that one or more sashes are being closed from an open position with respect to a baseline mark on the tape(s), it calculates the amount of movement in the sashes and signals the associated actuator to move in a pre-programmed amount with respect to the distance of the sash move closing to decrease the level of airflow being exhausted from the fume hood.

19. The controlling system in claim 18, such that the smart controller device will signal the airflow control device to close its proportional flow position with respect to the incremental combinational sash position change virtually instantaneously.

20. The controlling system in claim 19 such that the airflow control device will achieve its decreased flow position in less than a second after detection of the combinational sash movement.

* * * * *